United States Patent [19]

Hellat et al.

[11] Patent Number: 4,765,146

[45] Date of Patent: Aug. 23, 1988

[54] COMBUSTION CHAMBER FOR GAS TURBINES

[75] Inventors: Jaan Hellat, Baden-Rütihof; Jakob Keller, Dottikon, both of Switzerland

[73] Assignee: BBC Brown, Boveri & Company, Ltd., Baden, Switzerland

[21] Appl. No.: 80,254

[22] Filed: Jul. 27, 1987

Related U.S. Application Data

[63] Continuation of Ser. No. 828,663, Feb. 12, 1986, abandoned.

[30] Foreign Application Priority Data

Feb. 26, 1985 [CH] Switzerland ..... 861/85

[51] Int. Cl.[4] ..... F02C 1/00; F02G 3/00

[52] U.S. Cl. ..... 60/746; 60/758

[58] Field of Search ..... 60/746, 737, 740, 744, 60/758, 39.36, 748

[56] References Cited

U.S. PATENT DOCUMENTS

| | | | |
|---|---|---|---|
| 3,872,664 | 3/1975 | Lohmann et al. | 60/746 |
| 3,968,644 | 7/1976 | Fehler | 60/746 |
| 4,047,877 | 9/1977 | Flanagan | 60/746 |
| 4,192,139 | 3/1980 | Buchhein | 60/746 |
| 4,275,564 | 6/1981 | Kappler et al. | 60/746 |

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

The combustion chamber is characterized by an annular-cylindrical space, which consists of two reaction chambers (8), arranged at the end, and a collision chamber (12) placed therebetween. The reaction chambers (8) are fitted at their face-sided ends with a number of burner elements (A, B), arranged axially parallel, their number depending on the output of the combustion chamber, which burner elements are in each case mirror-symmetrical to each other in relation to the central axis of the collision chamber (12). From the collision chamber (12), an annular mixing chamber (15) goes off to the turbine inlet (17). Each burner element (A, B) is provided with a twist member (6, 11), which in each case is orientated in opposed sense of rotation compared with the mirror-symmetrically arranged twist member.

14 Claims, 5 Drawing Sheets

FIG.5
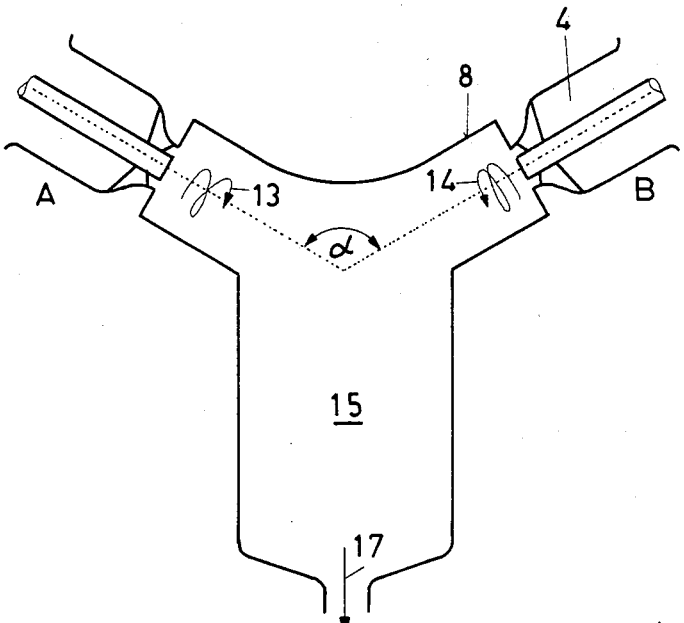
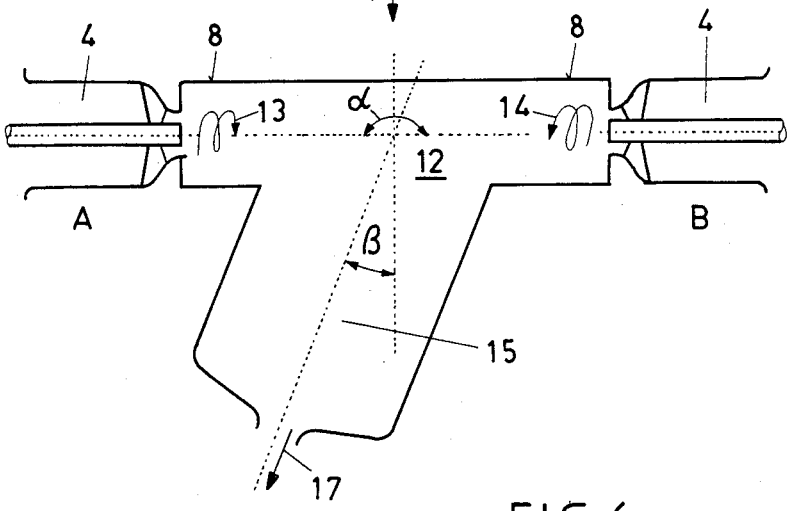
FIG.6

COMBUSTION CHAMBER FOR GAS TURBINES

This application is a continuation of application Ser. No. 06/828,663, filed Feb. 12, 1986 now abandoned.

FIELD OF INVENTION

The present invention relates to a combustion chamber for gas turbines generally and more particularly to annular combustion chambers for gas turbine engines having swirl devices. It also relates to a process for operating such combustion chambers.

BACKGROUND OF THE INVENTION

Combustion chambers with a number of burner elements distributed around the periphery of a substantially annular combustion space are known by the designation "annular combustion chambers".

Compared with separate combustion chambers, annular combustion chambers have the advantage that they make possible a more compact overall design of the gas turbine. The smaller dimensions result generally in cost advantages in production. The smaller surfaces of an annular combustion chamber also results in the cooling problems being more controllable. The disadvantages of this conventional design arise from the necesssity of dividing the output over individual burner elements, particularly if oil atomization and oil supply are problematical. Another disadvantage is also the difficulty of achieving an even a temperature distribution within a short operating length.

An annular combustion chamber is known from Swiss Pat. No. 585,373 which is provided with a number of swirl members arranged centrosymmetrically at its air inflow-sided and face-sided end. These swirl members are in each case disposed in pairs and it is evident that the swirl members can generate swirl flows with opposed senses of rotation. Also emerging from this publication is the interaction of the burner elements with the swirl members, it being possible for burner element and swirl member to be integrated in a premixing pipe. Nevertheless, the swirl members are arranged such that the individual swirl jets or swirl flows can only influence each other slightly.

It can be seen from the technique proposed by the Swiss patent that the desired irrotational flow with an even overall pressure cannot be produced within the combustion chamber length. An even temperature distribution at the turbine inlet is thus not ensured. Admittedly this disadvantage could be counteracted by a corresponding extension of the combustion chamber length. Nevertheless, this measure would mean that other disadvantages would have to be accepted. For instance, the structural engineering disadvantages caused by the extension of the combustion chamber length. However, of greater significance here is the impossibility of meeting the legislated limits on $NO_x$ emissions. The reason for this problem is that low $No_x$ emission values, disregarding the influence of an excessively high temperatures can only be maintained if the retention time of the gas particles in hot oxygen-free zones is as short as possible, namely no longer than a few milliseconds.

On the other hand, so that low CO emission values can be achieved, it is not permissible to drop below a certain limit temperature in the reaction region. This requirement sets a limit on small design sizes.

These requirements are not met without the existence of an intensive reciprocal mixing of various swirl flows, as there is the imminent danger here that the gas particles remain too long in the region of hot oxygen-free zones or subsequently are swirled back there, which has negative effects on the $NO_x$ emission values. The other danger is that the temperature in certain regions could drop below the limit temperature responsible for the CO emission values. In addition, it is known that the avoidance of $NO_x$ can be achieved with combustion chamber concepts with staged combustion. This staging may mean either an under-stoichiometric primary combustion zone with subsequent postcombustion at low temperatures or the staged switching-in of over-stoichiometric operated burner elements, for example premixing burners with increasing load. In any case, the staging also requires a powerful mixing mechanism to avoid the abovementioned problems. Thus, for example the supply of swirl free jets in a combustion chamber, as is the case with the postcombustion from the above Swiss Patent Specification, does not provide adequate mixing over a short stretch.

OBJECT AND SUMMARY OF THE INVENTION

This is where the invention provides a remedy. The invention is based on the object of minimizing the CO and $NO_x$ emissions in an annular combustion chamber. The combustion chamber is to be distinguished by a compact design with low pressure losses. In spite of the limited combustion chamber length, it is an object of the invention to provide an even temperature distribution at the turbine inlet. The objects of the invention are achieved by causing strongly twisted flows with opposed senses of rotation to collide in a mirror-symmetrical arrangement and in a small space, such that the two twist flows neutralize each other with regard to their twist, and by locating a relatively short mixing chamber, with a length which corresponds approximately to the hydraulic diameter or the clear width of the mixing chamber, downstream of the collision chamber so that the desired homogeneous temperature distribution in the gas flow upstream of the turbine inlet may be produced. Another advantage of the invention is that the admissible excess air coefficient region of the separate burners may be maintained by staged operation of the individual burner pairs. This regulation may, furthermore, be supported by different mass stream impingement of the individual mirror-symmetrically arranged burner elements. If this last-mentioned possibility is rendered independent, the entire operating range of the combustion chamber can be covered by just a few switching stages.

DETAILED DESCRIPTION OF THE PREFERRED EMBODIMENTS

Preferred embodiments of the invention are shown diagrammatically in the drawing, in which:

FIG. 5 is a combustion chamber according to a preferred embodiment of the present invention with reduced angle of collision $\alpha$; and FIG. 6 is a combustion chamber with an inclined mixing chamber according to a preferred embodiment of the present invention.

All elements not necessary for an understanding of the invention have been omitted. The direction of flow of the working medium is indicated by arrows. Identical elements in the various figures are provided with the same reference symbols.

Figure 1:
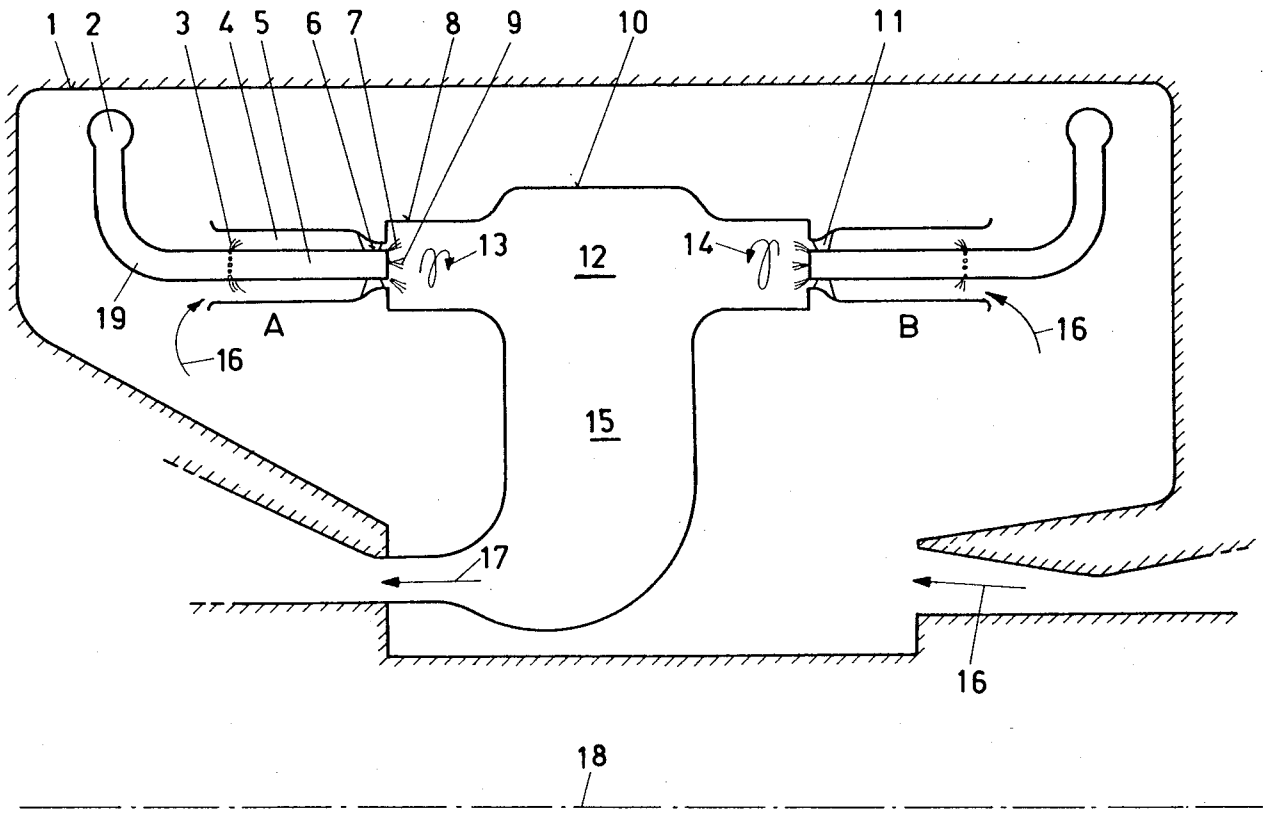
FIG. 1 is a section through a combustion chamber having an annular combustion space in accordance with a preferred embodiment of the present invention.

Referring to FIG. 1, a combustion chamber for gas turbines is accommodated in the gas turbine (GT) annular casing 1. If the entire combustion chamber is embedded in a GT annular casing 1, it is connected to compressor outlet 16 and turbine inlet 17. The GT annular casing wall in this case bears the difference between compressor end pressure and ambient pressure. The geometric form of the combustion space is, as the axial section 18 is intended to depict, annular and includes of two reaction chambers 8 arranged at the ends, symmetric to the central axis of the collision chamber 12, and of the collision chamber 12 placed therebetween. The reaction chambers 8 themselves are fitted at their axial ends with a plurality of burner elements A, B, arranged axially and parallel to one another, their number depending on the desired output of the combustion chamber. The two burner elements A, B, which are in each case mirror-symmetrical to each other in relation to the central axis of the collision chamber 12, are identically designed apart from the swirl members 6 and 11. For instance, the swirl member 6 in the burner element A is orientated in opposed sense of rotation compared with the mirror-symmetrically arranged swirl member 11 in the burner element B, as the indication of the swirl flows 13 and 14 depict.

The burner element A or B include a premixing pipe 4, a fuel nozzle 5, here a dual nozzle, and the aforementioned swirl members 6 and 11. A fuel supply line 19, which is connected to a fuel ring line 2, feeds the dual nozzle 5 with gas and/or oil. Such a dual nozzle 5 is described in detail in European Patent A No. 0,095,788. For this description, it suffices to know that the dual nozzle 5 consists of a number of concentrically arranged annular cylinders. The air from the compressor inlet 16 is enriched in the premixing pipe 4 with gas from the premixing nozzle 3 of the nozzle 5 the premixing 3. Gas is likewise used for operating the pilot nozzle 7. On the inside, there then follows the secondary air nozzle 9, which surrounds the central oil line opening out into an atomizer nozzle.

Extending from the collision chamber 12 is a radially inward directed annular mixing chamber 15, which then merges via a curvature into the turbine inlet 17. The collision chamber 12 has a bulge 10 opposite the mixing chamber 15, which bulge prevents one-sided burbling from taking place in the region of the inlet of the collision chamber 12.

The arrangement is such that strongly twisted flows with opposed senses of rotation 13, 14 in a mirror-symmetrical arrangement of the burner elements A, B are caused to collide in a small space. With suitable selection of the cross-sectional conditions, the twisting of the two swirl flows 13, 14 are cancelled completely after a length which corresponds to the clear width b of the mixing chamber 15. As a consequence, the flows are completely mixed after this length, which makes possible a homogeneous temperature distribution at the turbine inlet 17. The illustrated swirl member 6 in the burner element A is not only orientated an opposed sense of rotation compared with the mirror-symmetrically arranged swirl member 11 in the burner element B, but is also oppositely arranged as compared with the adjacent two swirl members on the same axial end. The same also applies to the swirl members 11 at the other axial end of the annular combustion space.

Figure 2:
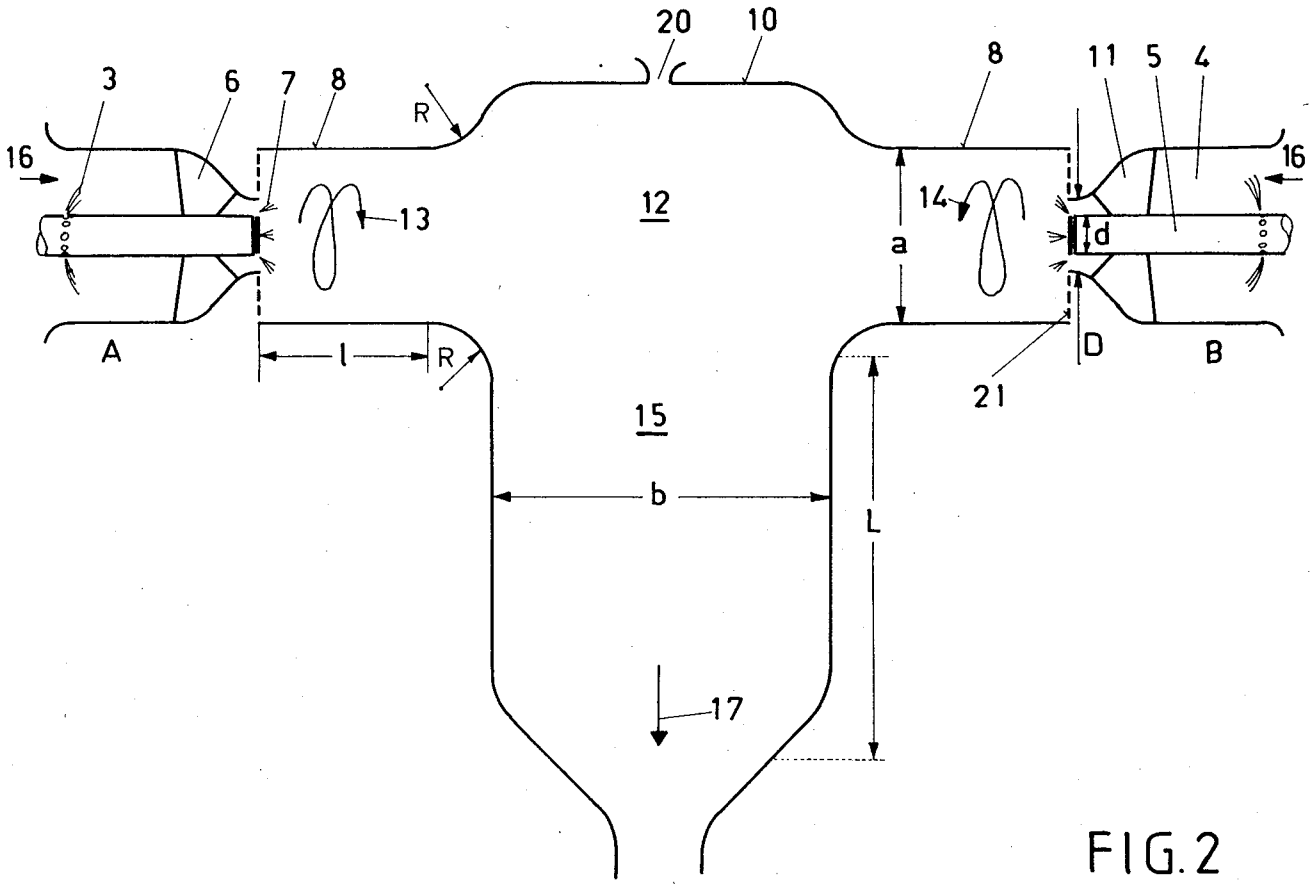
FIG. 2 is section through another combustion chamber, in accordance with a second preferred embodiment of the present invention.

FIG. 2 shows substantially the same combustion chamber as was explained with reference to FIG. 1. In order to achieve an adequately fast burn rate in the reaction chambers 8, the length l of the reaction chamber should be no more than 1 to 2 times the clear width a, so that an adequately fast burn rate is achieved by several measures downstream of the swirl member 6, 11. By a suitably strong twisting, which can be achieved by a flow discharge angle of the swirl members 6, 7 of about 45°, coupled with a nozzle-like constriction of the premixing pipe 4 of the swirl members 6, 11—a stable backflow zone (vortex breakdown) is produced in the reaction chamber 8, which first begins slightly offset from the burner plane 21 and which initiates the main reaction of the premixed air/fuel mixture. An initial ignition which approximately stabilizes the overall ignition operation and extends the limits of flash-back and lift-off originates from the pilot nozzle 7, 10% of the fuel and acts as a diffusion burner. The ratio of diameter d of the dual nozzle 5 to the diameter D of the nozzle end of the premixing pipe 8 preferably lies in the range of $\frac{1}{2}<d/D<\frac{1}{3}$. The ratio of cross-sectional area of the reaction chamber 8 to the free flow cross sectional area—between dual nozzle 5 and premixing pipe nozzle end D—of the burner elements A, B should preferably be at least 3 but not more than 8. The ratio of the cross-sectional area of the mixing chamber 15 to the sum of the cross-sectional areas of the reaction chambers 8 should be at least 1 but no more than 3. The length L of the mixing chamber 15 should be 1 to 2 times the clear width b. The wall part at the transition from a reaction chamber 8 to the mixing chamber 15 should preferably have a radius of curvature R which is about 1 to 3 of the clear width a of the reaction chamber 8. To avoid one-sided burbling in the region of the inlet into the collision chamber 12, a wall deflection with the same radius of curvature R is provided on the opposite side of the mixing chamber 15, which results in a bulge 10 at the outer circumference of the collision chamber 12. This geometrical specification of the combustion chamber supports the effects from the collision of the two twist streams 13, 14.

To avoid the permissible temperature limits in the reaction zones from being infringed either upwards or downwards, and to make possible the load regulation with high overall excess air coefficients, the combustion chamber is preferably operated with staged control. With increasing combustion chamber output, the fuel staging is chosen as follows when using premixing burners:

Pilot nozzle 7 (PD1) Stage 1
PD1+premixing nozzle 3 (VD1) Stage 2
PD1+VD1+PD2 Stage 3
PD1+VD1+PD2+VD2 Stage 4

The mixing mechanism, which is triggered by the frontal collision of the swirl flows 13, 14, is so strong that hot and cold flows (for example stage 2) can be mixed without any problems. In the case of the staging described, it is aimed to send the entire quantity of air delivered by the compressor 16 through the burner elements A, B. Excess air, which is not used for the controlled film cooling of the combustion chamber walls, may be introduced into the collision chamber 12 through nozzles 20. In this way the excess air is optimally mixed in. The mixing chamber 15 is open downwardly in the axis of the mixing chamber 15.

Figure 3:
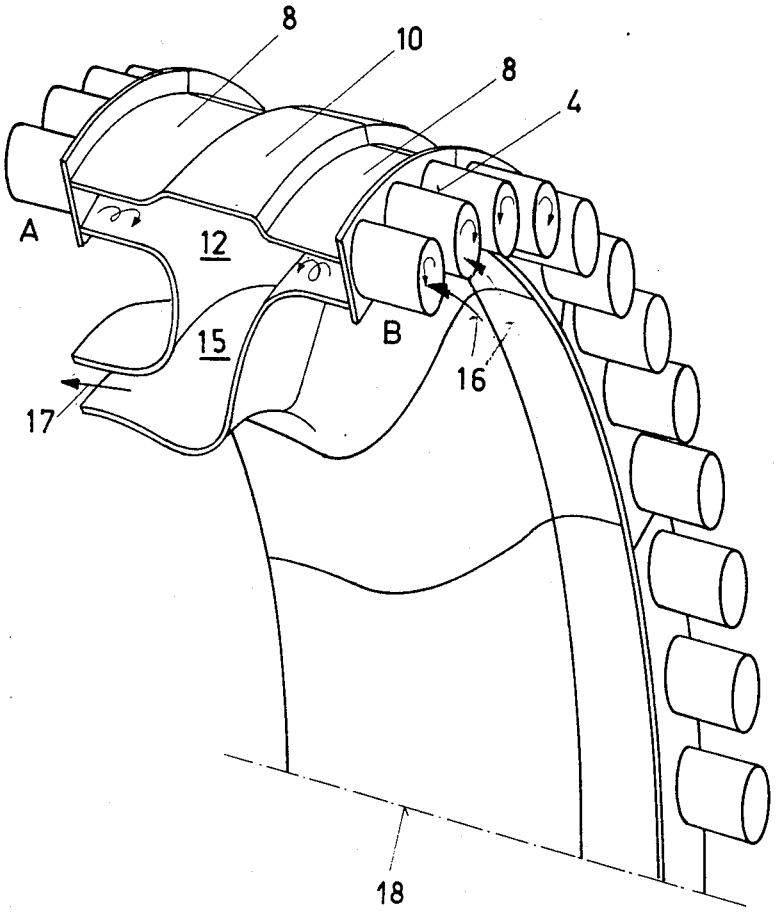
FIG. 3 is perspective view of the combustion chamber according to FIGS. 1 and 2.

FIG. 3 is a perspective view of the combustion chamber according to FIG. 1. It illustrates how the unseparated annular combustion space consisting of the reaction chambers 8 and the collision chamber 12 merges into a likewise unseparated annular mixig chamber 15. In principle, it would be conceivable to replace the unseparated design by a number of module-like combustion space units. These units would be arranged between the compressor and the turbine at regular intervals around the gas turbine axis, in which case the collision principle emerging from the arrangement of the burner elements A, B and the operating mode of the swirl members 6, 11 would be retained for each module. If the module size is reduced to the size of a burner element A, B, the annular combustion space merges into a cylindrical space, in which case the cross-sectional conditions listed above should be retained. The individual mixing chambers 15 would then have to, of course, open into an annular collecting chamber upstream of turbine inlet 17.

Figure 4:
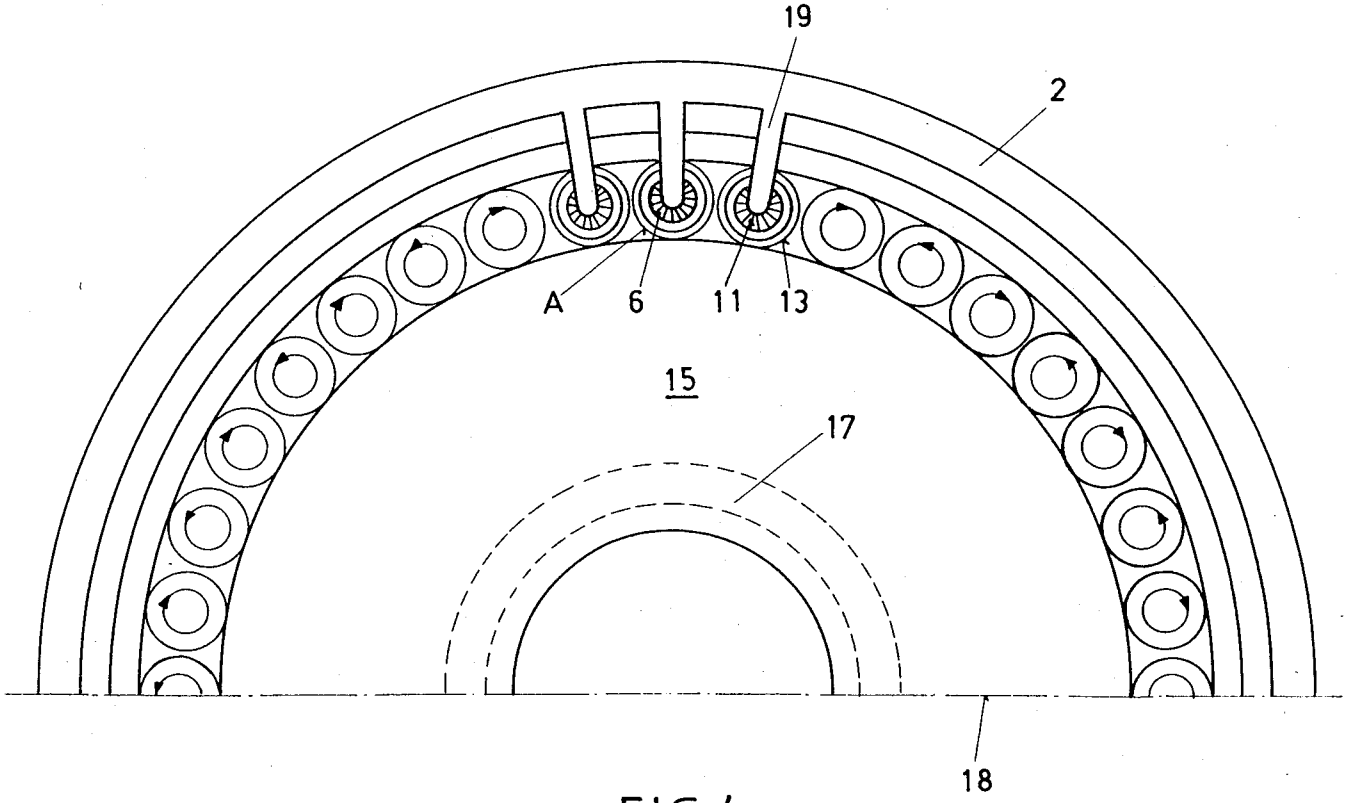
FIG. 4 is an end view of a distribution of the burner elements.

FIG. 4 shows how the individual burner elements A, B are mounted on the annular reaction chambers and distributed regularly around the periphery. In order for the individual opposite burner element pairs A, B, which produce twist flows of opposite rotational direction, do not substantially disturb each other in the case of certain combustion chamber sizes, the twist members 6, 11 in the individual burner elements A, B may have alternating senses of rotation in the circumferential direction.

FIG. 5 shows that the central axis through the burner elements A, B does not necessarily have to lie in one plane. However, it must be said here that the mixing mechanism is adversely affected to a greater or lesser extent even with optimum design of such modified variants. Under certain preconditions, the angle of collision $\alpha$ may be reduced to about 120° before a clear deterioration of the combustion chamber arises with respect to mixing. Deviations from the central axis symmetry are also conceivable.

FIG. 6 shows the precautions to be taken if the mass stream through the burner element B is, for example, greater than the mass stream through the opposite burner element B. Different mass streams come into consideration if the entire operating range of the combustion chamber is to be covered by just a few switching stages. However, this is at the expense of a substantial deterioration in the mixing of the twist flows 13, 14. This may be avoided by the axis of symmetry of the mixing chamber 15 deviating by a suitable angle $\beta$ from the original plane of symmetry. With mirror-symmetrical burner elements A, B with angle of collision $\alpha = 180°$ and twice the mass stream through burner element B compared with burner element A, the optimum inclination of the angle $\beta$ with respect to the latter is about 30°.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. An annular burner assembly for a gas turbine comprising:

an annular collision chamber;

a first annular reaction chamber communicating with a first side of the collision chamber;

a second annular reaction chamber communicating with a second and opposite side of the collision chamber;

a first annular array of means for directing a plurality of swirled mixtures of fuel and air into the first reaction chamber;

a second annular array of means for directing a plurality of swirled mixtures of fuel and air into the second reaction chamber;

said directing means having a fuel nozzle, a premixing tube, and a swirl body;

said first array being in a first plane and said second array being in a second plane that is parallel to said first plane;

each of said directing means in the first array including means for imparting a swirl in a first direction to said mixtures emitted from the first array, and each of said directing means in the second array including means for imparting a swirl to said mixtures emitted from the second array, such that each swirled mixture emitted from the first array encounters in the collision chamber a swirled mixture emitted from the second array, said swirled mixture from the first array traveling in a substantially opposite direction and swirling in an opposite state from the swirled mixture from the second array of directing means.

2. The annular burner assembly of claim 1, wherein:

a length of each of the reaction chambers being in the range of 1 to 2 times its internal width, the premixing tubes having a constriction downstream of the swirl bodies, a ratio of a diameter of the fuel nozzle (d) to a diameter at an end of the constriction of the premixing tube (D) being in the range of $\frac{1}{3} < d/D < \frac{1}{2}$, a ratio between the axial cross-sectional area of each of the reaction chambers and the free flow cross-sectional areas of the burner elements opening therein, defined as the area between the fuel nozzle diameter (d) and the end of the constriction (D) of the premixing tube, being in the range of a minimum of 3 and a maximum of 8.

3. The annular burner assembly of claim 1, further comprising a mixing chamber, wherein:

a ratio of the radial cross-sectional area of the mixing chamber and of the sum of the axial cross-sectional areas of the reactions chambers being in the range of a minimum of 1 and a maximum of 3, a length of the mixing chamber being in the range of 1 to 2 times its diameter, a radius of curvature at a transition between each of the reaction chambers and the mixing chamber being approximately $\frac{1}{3}$ of the internal width of each of the reaction chambers, and the mixing chamber being located centrally with respect to an axis of symmetry of the collision chamber.

4. The annular burner assembly of claim 1, wherein opposing directing means are directed in the range of 110° to 180° with respect to each other.

5. An annular burner assembly for a gas turbine, comprising:

an annular collision chamber;

a first plurality of burner elements, said burner elements arranged on a first side of said collision chamber and including means for emitting a fuel-/air mixture into the collision chamber in a first direction and with a first directed swirled state;

a second plurality of burner elements, said burner elements arranged on a second side of said collision chamber and including means for emitting a fuel-/air mixture into the collision chamber in a second direction and with a second directed swirled state that is opposite of the first directed swirled state;

said first plurality of burner elements being arranged substantially parallel with one another;

said second plurality of burner elements being arranged substantially parallel with one another;

said first and second plurality of burner elements being arranged such that each burner element of the first plurality faces in a substantially opposing manner a burner element of the second plurality.

6. The annular burner assembly of claim 5, wherein each of the burner elements includes a fuel nozzle, a premixing tube, and a swirl body.

7. The annular burner assembly of claim 5, wherein each of said burner elements is connected to a reaction chamber which reaction chamber communicates with the collision chamber.

8. The annular burner assembly of claim 5, wherein the first and second plurality of burner elements oppose each other at an angle within the range of 110° to 180°.

9. A burner assembly for a gas turbine, comprising:

a collision chamber;

a first reaction chamber communicating with a first side of the collision chamber;

a second reaction chamber communicating with a second and opposite side of the collision chamber;

a first array of means for directing a plurality of swirled mixtures of fuel and air into the first reaction chamber;

a second array of means for directing a plurality of swirled mixtures of fuel and air into the second reaction chamber;

said first array being in a first plane and said second array being in a second plane that is parallel to said first plane;

each of said directing means in the first array including means for imparting a swirl in a first direction to said mixtures emitted from the first array, and each of said directing means in said second array including means for imparting a swirl to said mixtures emitted from the second array, such that each swirled mixture emitted form the first array encounters in the collision chamber a swirled mixture emitted from the second array, said swirled mixture from the first array of directing means traveling in a substantially opposite direction and swirling in an opposite state from the swirled mixture from the second array of directing means.

10. The burner assembly of claim 9, wherein each of the directing means includes a fuel nozzle, a premixing tube, and a swirl body.

11. The annular burner assembly of claim 10, wherein:

a length of each of the reaction chambers being in the range of 1 to 2 times its internal width, the premixing tubes having a constriction downstream of the swirl bodies, a ratio of a diameter of the fuel nozzle (d) to a diameter at an end of the constriction of the premixing tube (D) being in the range of $\frac{1}{3} < d/D < \frac{1}{2}$, a ratio between the axial cross-sectional area of each of the reaction chambers and the free flow cross-sectional areas of the burner elements opening therein, defined as the area between the fuel nozzle diameter (d) and the end of the constriction (D) of the premixing tube, being in the range of a minimum of 3 and a maximum of 8.

12. The annular burner assembly of claim 9, wherein opposing directing means are directed in the range of 110° to 180° with respect to each other.

13. The burner assembly of claim 9, wherein the first and second reaction chambers are annular.

14. The burner assembly of claim 13, wherein the first and second arrays are annular.

* * * * *